United States Patent [19]

Matschke

[11] 4,218,148

[45] * Aug. 19, 1980

[54] MATRIX PRINTING CELL AND HEAD ASSEMBLY

[75] Inventor: Arthur L. Matschke, Westport, Conn.

[73] Assignee: Printer Associates, Keene, N.H.

[ * ] Notice: The portion of the term of this patent subsequent to Jan. 16, 1996, has been disclaimed.

[21] Appl. No.: 852,955

[22] Filed: Nov. 18, 1977

Related U.S. Application Data

[63] Continuation-in-part of Ser. No. 815,718, Jul. 14, 1977, Pat. No. 4,134,691, which is a continuation of Ser. No. 646,626, Jan. 5, 1976, abandoned.

[51] Int. Cl.[2] ..... B41J 3/12

[52] U.S. Cl. ..... 400/124; 101/93.05

[58] Field of Search ..... 101/93.05; 400/124; 335/270, 271

[56] References Cited

U.S. PATENT DOCUMENTS

| | | | |
|---|---|---|---|
| 3,187,668 | 6/1975 | Marsh | 101/93.02 |
| 3,335,659 | 8/1967 | Schacht et al. | 101/93.02 |
| 3,467,232 | 9/1969 | Paige | 400/124 |
| 3,842,737 | 10/1974 | Gomi | 101/93.34 |
| 3,842,955 | 10/1974 | Iwasaki | 335/270 X |
| 3,893,220 | 7/1975 | Bittner | 400/124 X |
| 3,897,865 | 8/1975 | Darwin et al. | 400/124 |
| 3,994,381 | 11/1976 | Hebert | 400/124 |
| 4,004,671 | 1/1977 | Kondur | 400/124 |

*Primary Examiner*—Paul T. Sewell

*Attorney, Agent, or Firm*—James J. Burke, II

[57] ABSTRACT

An improved printing cell and head for dot matrix impact printers, including an armature of exceptionally low mass mounted on a pair of straight, cylindrical spring elements, and driven by a pair of coils wired in parallel. By careful selection of the ramp angle of respective pole faces, and a resilient preset and energy-absorbing device, printing speeds of 2,500 Hz can be achieved with remarkably quiet operation.

22 Claims, 5 Drawing Figures

MATRIX PRINTING CELL AND HEAD ASSEMBLY

RELATED APPLICATIONS

This application is a continuation-in-part of U.S. Appln. Ser. No. 815,718, filed July 14, 1977, now U.S. Pat. No. 4,134,691 issued Jan. 16, 1979, which was a continuation of U.S. Appln. Ser. No. 646,626, filed Jan. 5, 1976, now abandoned.

BACKGROUND OF THE INVENTION

The present invention relates generally to dot matrix impact print heads and the electromagnet assemblies which are used therein.

In my above-noted patent there is disclosed a rugged and reliable electromagnet assembly and print head which is adapted for operation at moderate speeds, 60–90 characters-per-second (cps), or about 480 Hz (cycles per second), with a long and powerful stroke that is capable of producing 4–10 copies on varying print stock. Each electromagnet assembly includes a U-shaped core having two sloped pole faces at the top, the degree of slope being called the "ramp" angle, and being in the range of 7 to 26 degrees of incline to the axis of the print-wire extending thru the armature. Each core carries a coil wound thereon. The armature is mounted above the cores by two flexure elements, e.g. flat springs, screwed into the base of the core and at the ends of the armature. The print-wire is welded inside the forward screw on the armature. The latter has a pair of pole faces substantially mating with the core pole faces and defining a perpendicular and closeable gap. A saddle on the rear of the core and separately mounted in assembly with the core into a head includes an adjustment screw for pretensioning the armature-spring assembly. The screw deflects an intermediate pierlike member which is in line contact with the deflected flat spring and armature components and acts as a rigid brace for the returned spring-armature assembly upon the completion (return) of its forward deflection. A desired number of these assemblies are mounted in a parabolic array in a generally conical head casting, which has a suitable nose bearing receiving the printing ends of the print wires.

In operation, movement of the armature-spring assembly is described as a "collapsing trapezoid", and it is significant that while there is a slight vertical displacement of the armature-print wire during movement (less than the wire radius), there is no angular change; this distinguishes this type of assembly from previously-known clapper-type print cells, (wherein an electromagnet is not located co-linear with the axis of wire motion, e.g., any departure from the standard cylindrical linear solenoid which has a coil and center armature). Such "clapper" cells revert somewhat to the buzzer or clapper-bell design wherein a cantilevered armature is located and acted upon by a coil pole at one end. The angular pivoting of the armature, by having a print-wire affixed to one end, permits movement of the wire at whatever frequency the armature can be made to move in and out from the coil. If the print-wire is attached to the armature which is pivoting about a fulcrum, the wire end attached to the armature is "S-flexured" to the same angle of rotation as the armature. This absorbs energy required to print and reduces print-excursion frequency. Some later developments of the "clapper" design have separated the wire from the armature to avoid this problem. However, several advantages of having the wire secured to the armature and affording a geometry which will permit very high print-excursion frequencies at the same time, are demonstrated in the present invention.

The present invention follows the broad structural outline of the above-described cell and head, but is improved in substantial and significant ways which bring about dramatically improved operation.

Prior art considered relevent but not anticipatory is discussed in some detail in my afore-mentioned patent.

OBJECTS OF THE INVENTION

A general object of the present invention is to provide an improved printng cell for dot matrix impact print heads.

Another object of the present invention is to provide a printing cell of substantially lower mass and higher printing speed than previous cells.

A further object of the present invention is to provide a printing cell capable of quieter operation at higher frequencies than previous cells.

Various other objects and advantages will become clear from the following description of embodiments, and the novel features will be particularly pointed out in connection with the appended claims.

THE DRAWINGS

References will hereinafter be made to the accompanying drawings, wherein.

DESCRIPTION OF THE EMBODIMENTS

Figures 1, 5:
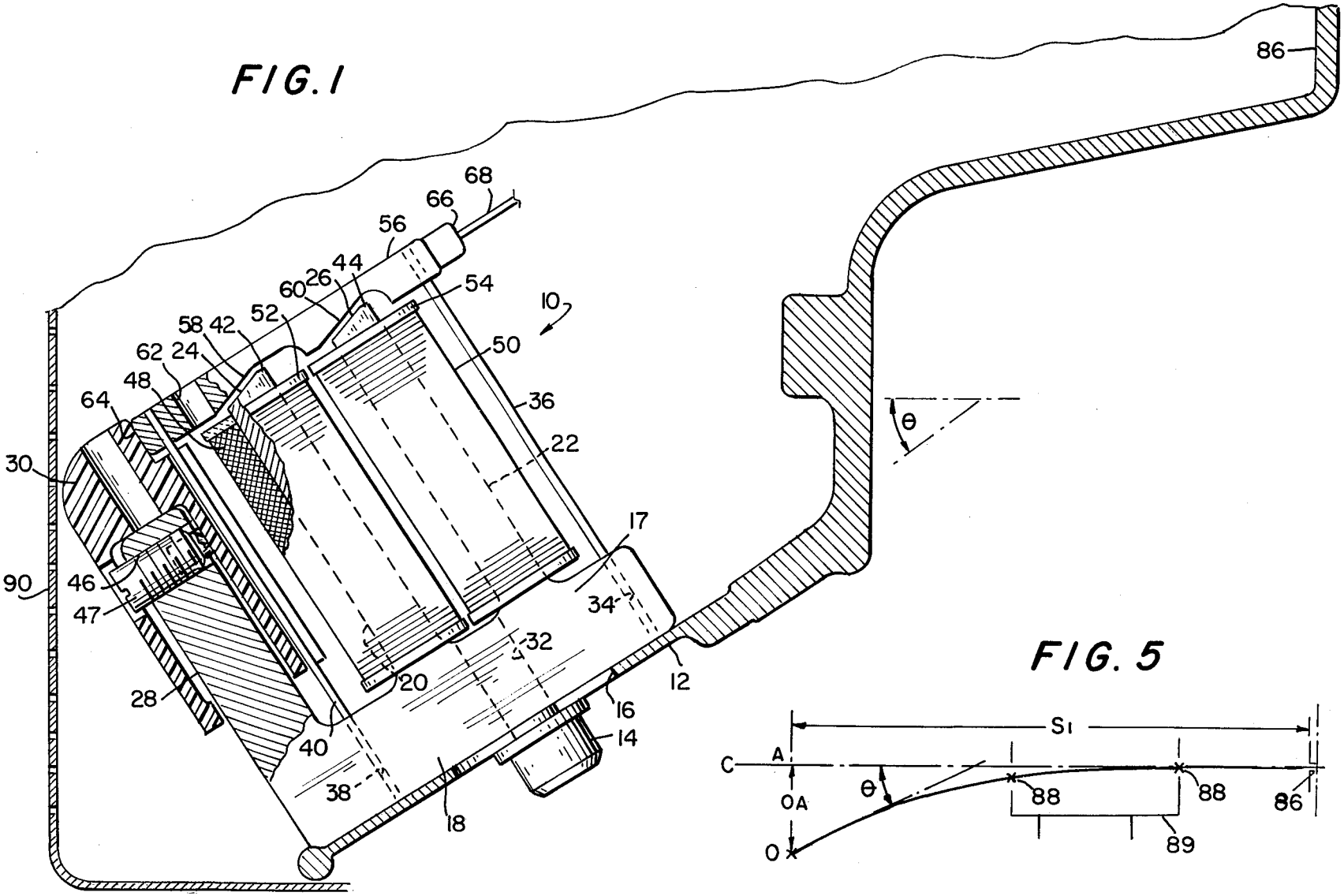
FIG. 1 is an elevation view, partly in section, of an electromagnet assembly in accordance with the present invention and including the head casting in which it is mounted.
FIG. 5 is a schematic side view showing the wire path of a single electromagnet assembly representing any assembly in the head array.

In one aspect, the present invention comprises replacement of the flat spring flexure elements of my previous printing cell with cylindrical wire springs which at their respective ends, are welded or sintered into holes in the core and armature at a point which removes these components from an impact-distorting relationship with other components of the structure. By itself, this improvement eliminates four screws and allows the mass of the armature to be significantly reduced as well as the total weight of the cell assembly.

In another aspect, the present invention introduces a new element in matrix impact print cells that is called a "preset". The preset performs several other functions as well armature-damping, which contributes to the ability of the device to achieve impact frequencies of over 2,500 Hz, and to do so with a remarkably quiet action. Like a damping element, the preset has some resiliency, and is contacted by the rear face of the armature.

Additionally, as the name implies, the non-magnetic preset is initially adjusted to set the required air-gap between the armature-core pole faces with a minimum tension in the armature-spring assembly, by applying pressure exclusively to the armature. Unlike the earlier saddle element, the preset does not "preform" the spring, which adds to the pre-load of the operating electromagnet. Still further, the preset encloses or nests the rear-spring element on three sides to prevent off-axis wandering of the armature-spring assembly, but does not contact the spring component in the rest position. On the return stroke during operation, the preset "nests" the spring element, which then touches the 'floor' of the nest, curved to receive the spring element. An integral element not shown in the drawing is a resilient adhesive which is added to the assembly of the preset and its mount while permitting a setting-adjustment of the preset in initial assembly, and allowing some deflection of the preset during impacting of the armature-spring assembly during operation. The adhesive is cured during post-assembly and becomes attached to both the preset and the core 'tower' section combined with the core element.

With reference to FIG. 1, the electromagnet assembly 10 is mounted in a print 'head' casting 12 by means of a single screw 14. Electromagnet assembly 10 has eight parts. The core 17 is generally W-shaped, and includes base portion 18, two parallel cores 20, 22 terminating in sloped pole faces 24, 26. The third 'leg' of the "W" is 'tower' portion 28 which supports preset 30, described hereinbelow. Base 18 has a central, threaded hole 32 to receive mounting screw 14, hole 34 at the forward end to receive columnar spring 36, and, between core 20 and tower portion 28, hole 38 to receive rear spring 40 in assembly.

A slot 16 in casting 12 which accepts screw 14 allows assembly 10 to be adjusted in the axial (print-wire) direction so as to not introduce a bias flexure into the print-wire. As an alternate the screw can be replaced with a male stud (not shown) extending from the core base. Such an alternative would reduce the cross-section of the base and further reduce core weight as additional cross-section is added in the present embodiment to compensate for the tapped hole 32. However, studs so applied have a tendency to fracture, and additional means adding to costs have to be provided for the alternate embodiment.

In the present invention, the ramp angle of pole face 24, 26 has been refined, and falls in a range of 16 to 20 degrees of angle (the angle being measured from the axis of the print-wire). An angular difference is introduced between ramp interfaces of the armature faces 58, 60 and the core faces 24, 26, to avoid 'locking' of the operating components in operation. Under certain conditions in a machine without paper (the printer equipment using the invention), the armature and core pole faces may be caused to contact. To avoid 'wedge-locking' contact in this event, the armature is designed with a tolerance toward a negative value, resulting in an angle of approximately one quarter of a degree acute from the specified ramp angle of the core. This intentional difference of ramp-mating angles between the core and armature does not introduce a discernable change in operation at the frequencies and power level ranges at which the present embodiment has been operated. A consideration that must be taken for satisfactory operation with this angular difference, is the axial dimension (length) of the ramps involved vs. the ramp angle ratio. An approximate ratio of ramp length to angular 'error' must also include a variable for the desired stroke length and frequency, but I have generally specified a minimum ratio of 50:1.

Core 17 is of course manufactured from a suitable magnetic material having high permeability, high electrical resistivity, a narrowest possible hysteresis loop, maximum density, extremely low coercive force and low residual induction. Further, a preferred fabrication method in this embodiment is that of powdered metallurgy which affords the use of silicon alloys (as an alternate to the ideal pure iron material of highest permeability) without brittleness encountered in wrought materials. An acceptable material used in the present embodiment is a 3 percent silicon alloy which offers a compromise between the detrimental effect of too-low a resistivity and lower saturation values of too high a silicon content. It is preferred that the armature be composed of pure iron for maximum permeability (Armco (TM) Ingot iron has been used) and that the core be manufactured of a 3 percent silicon-iron alloy, to maintain a higher level of resistivity in the core which affords a fast magnetic 'decay' time, thus, reducing the probability of residual magnetism, or "magnetic hang-up" in-cycle, a common problem at higher frequencies.

In my previous design I preferred a slight bevel at the uppermost, forward edge of the core pole face. I have now discovered and prefer that equal or better performance is achieved if this edge is milled flat 42, 44; in one embodiment this amounted to 0.010" (in). In either case the desired end is to avoid flux leakage to the closely set armature in the neutral position.

Tower 28, the function of which is to support preset 30, has a transverse threaded hole 46 therethrough near the top to receive a set screw 47. The set screw is of the commercially available type having a nylon insert at its tip, or nose, which is used as a means of dispersing the high-density forces occuring at the contact point between the screw and the inner preset surface, a pressure point on the preset used to overcome the armature-spring resistance to a pre-load setting of the armature gap. Further, the use of a nylon tipped screw has eliminated any deterioration in the setting after hundreds of millions of operating cycles, and the overall resilient relationship of the preset to the operating armature. When set, screw 47 is secured in manufacture with one of several commercially available sealants for that purpose.

The height of tower 28 is sufficient for its function in the location of a pressure point herein described, and operating in conjunction with a fulcrum point 80, but not so high as to interfere with the magnetic circuit (e.g., establish a flux path to the armature).

Magnetic cores 20, 22 carry a pair of coils 48, 50 wound on plastic bobbins 52, 54. The cross-section of cores 20, 22 is generally square with 'broken' or rounded corners, having a somewhat greater dimension axially along the core base to achieve the selected core cross-sectional area and minimizing cell (core) width. The long axis of the mating core faces is thereby emphasized in the direction of armature movement. Wire sizes and the number of turns in coils 48, 50 are determined on the basis of the particular cell specification, viz., core cross-section and the desired number of ampere-turns. It is essential in a higher frequency application that the coils be wired in parallel, as low coil inductance contributes measurably to the operating speed of the cell while adding ampere-turns. Bobbins 52, 54 should have a clearance fit on cores 20, 22 and be made of a material of suitable resiliency and other physical properties such as absorption, resistance, strength, heat resistance, etc. The selected material in one embodiment has been nylon, but other materials may be used. Bobbin structure and sizing to the core, as well as resiliency after winding, is carefully determined, as it is known that the coil wires move upon energization and this affects life capabilities. Broken corners (edges) of the cores 20, 22 minimize wire break-thru and bobbin wear. ('Broken' is the vernacular for rounded, tumbled or otherwise made with a radius in production). Parallel wiring of coils permits lower input voltage than if as many turns were wired in series, and thus decreases current rise-time.

As noted, wire springs 36, 40 are secured in base portion 18 of core 17 at their lower ends. At their upper ends, they are secured in and support the armature 56. Both ends of the spring-wires thus have equal resistance about their perimeter surface, and provide a consistent and determinate deflection value for the specified spring length. Further, the spring members, being of circular cross-section, are not susceptible to edge fracture in the manufacturing process, which precipitates spring failure, e.g. metal fatigue and separation. The circular (columnar) spring offers greater strength with less mass carried by the armature, (than if the spring were non-circular), and contributes significantly to the overall electrical and geometrical properties necessary to achieve demonstarted current response time and velocities. As a spring material a commercially available beryllium copper is preferred. It is known to those experienced in the art that the appropriate spring rate may be achieved with phosphor bronze or nickel alloys, with or without suitable coatings to further extend surface life. Stainless steel and other materials having magnetic properties (or not) have been used satisfactorily in the embodiment at slower frequency applications. The size (diameter) selected for the present embodiment provides a minimum stress which should lead to infinite life.

Welding of the wires into their mounting holes is the preferred technique an assembly is simplified and no heat treating is required afterwards for either the magnetic materials or the spring materials. A further object of the use of columnar springs is the avoidance of spring working (e.g., holes or shaping) and subsequent heat treating, and the simplified diminsioning afforded as the spring lengths terminate in hole lengths which are greater than the required bearing surface, thus affording substantial tolerances for spring fabrication. Further, the use of parallel hole locations requires relatively straightforward machining technology, simplified assembly (by weldment of springs after placing of preset over the tower), and a favorable geometrical tolerance leverage wherein the parallelism of the spring and holes, and their location in the base and core do not have severe accumulative affect on overall performance and manufacturing costs (using tolerances of nominal value as 0.003–0.005") as the sine-function of the magnetic gap permits an approximate three to one ratio advantage (e.g., a three thousandth placement error of the springs in assembly result in somewhat less than a 0.001" error in gap). Considering that allowances in the nominal gap setting have been provided by design and initial setting adjustment, it can be seen that manufacturing precision can be dedicated to parts character and that the design is not susceptible to failure as a function of wear.

Armature 56 extends over pole faces 24 and 26 and, as noted, is supported by column springs 36, 40. In cross-section, it too is generally square with "broken" or rounded edges, and cut-out portions forming armature-ramp faces 58, 60 are gap-closeable mating components for core pole-ramp faces 24, 26 (as heretofore described with angular variations included). The rounded edges on the armature and throughout the core help to minimize flux leakage from the magnetic circuit. The elimination of screws in the armature makes possible a significant reduction in mass. In one embodiment, the armature mass is approximately one half of a gram, which for the purpose of force calculations, includes the weight of the spring section and print-wires moved. A vertical hole(s) 62 near the rear end (and front, not shown) further reduces mass without affecting structure. The rear face 64 of armature 56 contacts the preset 30, and the front face 66 has the print-wire secured therein, by either welding or sintering.

Figure 2:
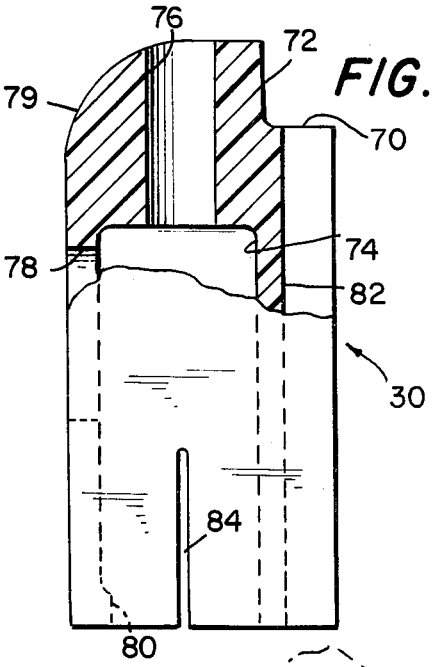
FIGS. 2 and 3 are elevation and plan views, respectively, of the preset element used in the invention.
Figure 3:
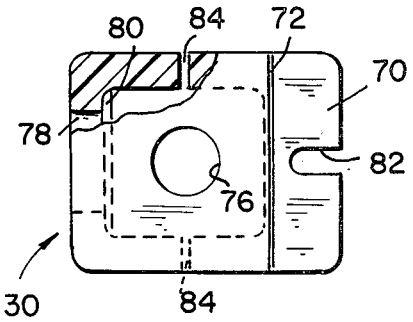

Preset 30 is shown in more detail in FIGS. 2 and 3, and attention is directed to this component. It should be manufactured from a material having the appropriate physical properties of strength, absorption-resistance, heat resistance and surface (friction) co-efficient including a mild resiliency for the immediate contact with the armature, and intermittent sliding relationship with the rear columnar spring. Glass filled Delrin (TM) and G.E. Valox (TM) and nylon have been selected as acceptable materials. In elevation, preset 30 is generally rectangular, but has a cutout step section including tread surface 70 and (contact) riser surface 72 at its upper end. Centrally on the long axis a cavity 74 is provided, which is somewhat larger than tower 28 and more so in the axial direction of preset and armature adjustment with only slight clearance in the width dimension to permit movement without constraint. A vertical aerating hole 76 is provided between cavity 74 and the top of the preset for providing expansion and curing means of the aforementioned resilient adhesive. A horizontal hole 78 at the rear surface matches thread hole 46 in tower 28 with additional clearance for the aforementioned set screw 47 and angular desplacement of the preset when the screw is advanced thru the preset hole and engaged in the tower thread 46. Inside the cavity 74 in the lower rear edge of same is a ridge portion 80 acting as the fulcrum for tilting the preset in setting adjustment (of the armature gap, as described). As seen most clearly in FIG. 3, preset 30 also includes a vertical slot 82 centrally disposed in the front face thereof. Generally, the size of the slot 82 will be such that there will be from one to a few thousandths clearance all around spring-wire 40; in operation wire 40 never leaves slot 82. It is important to note that, in the rest position, wire 40 does not touch any surface of slot 82; the only contact between preset 30 and the armature assembly is at surfaces 64 and 72. It is preferred than when in contact that armature surface 64 and preset surface 72 be parallel, or nearly so to minimize edge contact and possibility of wear. Therefore, a negative incline (with respect to the vertical axis of preset 30) is introduced into riser surface 72 such that when the armature-gap setting is achieved, then the tilted preset riser surface 72 will be in a more-nearly parallel relationship with armature contact surface 62. It should be noted again, that the armature does not rotate throughout its excursion and therefore the angle considerations are for the preset component only. Additionally, preset 30 is provided with vertical dieparting slots 84 in the side walls to facilitate removal after molding.

Assembly of most of cell 10 is apparent from the foregoing description, except for the mounting of preset 30 in manufacturing assembly. As seen in FIG. 1, there are clearances heretofore described to permit the tilting adjustment of preset 30. To fill this space a suitable amount of resilient adhesive is placed as a glob, or dispensed onto the tower 28 before assembly.

This material has been carefully selected and tested for the many physical characteristics and adhesion properties required throughout a range of temperature and humidity conditions. A high-temperature, resilient silicone sealant has been selected with a ten year life and is described by its manufacturer as G.E. 2562-01DP. This sealant has a long curing time which provides a practical manufacturing interval for set screw introduction after assembly of the preset over the tower and adjustment of the armature-spring assembly. Further adjustments in the head can be made which employ the resilient relationship and are not prevented because of the slow-curing adhesive. In assembly, the adhesive generally fills the void between cavity 74 and tower 28 and with the aerating hole 76 helping to distribute the material as desired.

An important function of the preset 30 is the efficiency with which it aborts, re., absorbs, or dissipates forces developing by the returning armature-wire assembly. Extending as it does above the tower 28 and being additionally resiliently-mounted, the mass of the preset does make a significant contribution to the rapid distribution of the forces involved. The weight of the preset, mounted as it is, and so used, contributes to the principle of operation. In achieving adequate force distribution at frequency, the minimum mass of the preset and its positioning have been determined by experimental trial. Corrections have been introduced in the final shaping of the preset by removal of material at radius 79, to accomodate the armature-mass of one embodiment at a frequency range thereof.

Casting 12 is, in section, of a generally conical shape and is a portion of a cone depending upon the number of print-cells to be combined into one head. It is significant that two conditions are satisfied by the invention which relate to improvements in the art of impact matrix printing. They are the reduced mass (of the head as well as the individual print-cell), and the ability to use more print-cells in one head without negating print-wire path affects, or incurring severe inertial losses (machine operating time) as a result of increasing the number of print cells (weight). It should be noted that this invention is about one half the size and mass of my prior cell, supra. These conditions are apparent in the layout shown. Electromagnet assemblies 10 are mounted at the rear end of casting 12, with print-wires 68 passing to a nose bearing 86 through a curve, with constraining tabs, or guides at 88. Because of the size and shape of the print-cell invention, the print wires can be positioned with exact replication of each cell print-wire and with an in-line (planar) curve which permits each wire to avoid any change in torque loads, or pressure points, individually or one to another by comparison, in the head assembly. In the art typically, an annular separation of coil-cells of larger diameter at the point of origination of the print-wire, requires individual path shapes for each coil (which are reversed in opposing quadrants), with near paraboloid and intermediate guides introducing inconsistent radial loads as the wires are joined in the final print formation at the nose bearing. In the present invention, the narrow width of the print cell permits placement of the print cells such that each print-wire has the identical curve, and without displacement regardless of its origination.

Figure 4:
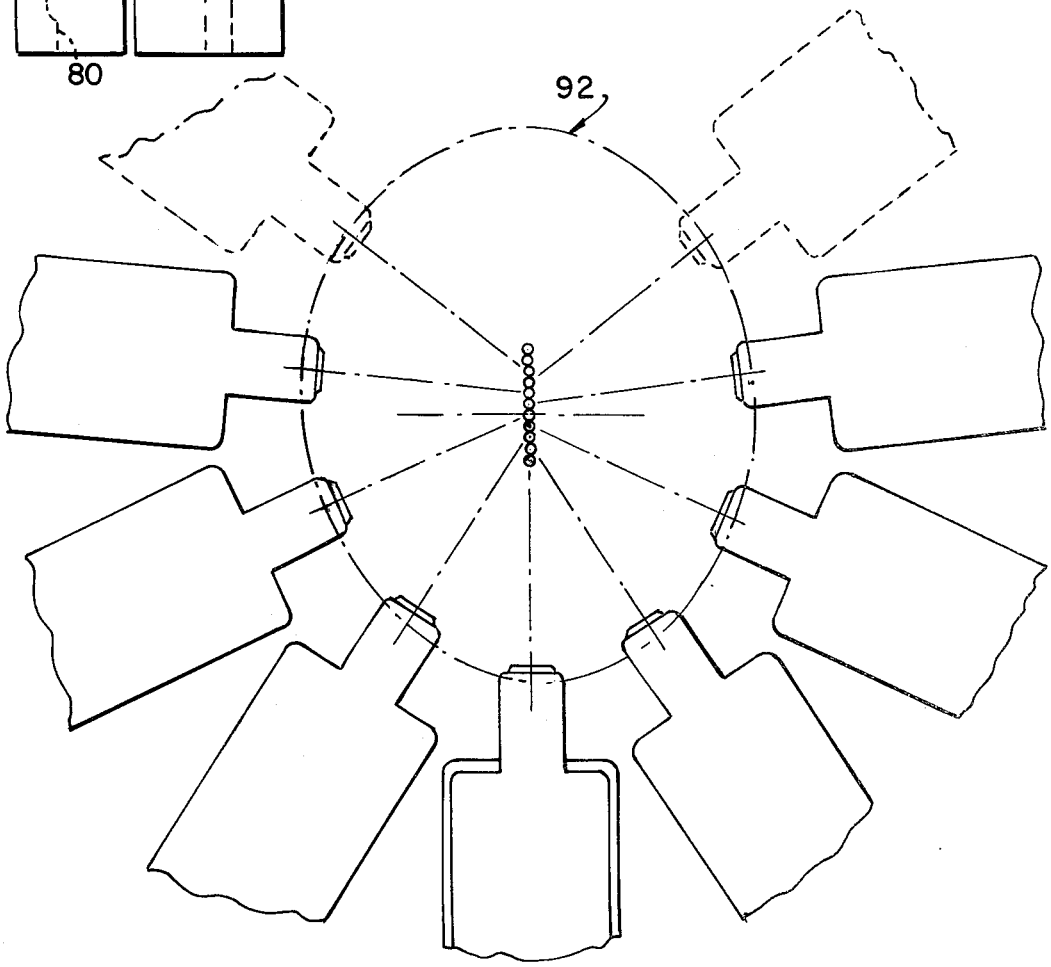
FIG. 4 is a schematic layout illustrating the positioning of seven or nine printing cells in a parabolic array with additional space for more cells around the interior of the casting shown in FIG. 1.

FIG. 4 illustrates the placement of cells 10 in casting 12 in schematic fashion. To insure that each print-wire has exactly the same length and path of travel, which is essential for quality printing and particularly high speed printing, cells 10 are disposed on the vertical axis by and at a constant distance from the print-wire bearing hole, a dimension I refer to as value OA (FIG. 5), with each cell "pointed" such that the center-line of the cell is coincident with the print-wire path and the bearing hole. Wire bearing holes are typically contiguous in a vertical column and with the constant distance OA wire-path from each cell a paraboloid cell mounting array pattern is evident. However, wire bearing holes may be aligned differently as in a double row which can be accomodated with the "planar" shape of the invention and positioning of the cells in a head is not necessarily confined to either an annular or parabolic-like array. Further, the actual size of the mounting parabola, and the angle $\theta$ at which the cells are mounted with respect to the axis of the head casting (FIG. 5), are selected for (1) the desired print-wire curvature and (2) sufficient inter-cell spring to prevent heating and crosstalk problems, for the number of cells selected. FIG. 4 shows that a 7, 9 or 11 wire head can be built on a single casting 12. It can be shown that increasing the diameter slightly (OA—of the mounting circle) will permit a larger number of cells to be mounted with no sacrifice to the planar-wire embodiment. In addition, the print-wire curve can be greater than in previous cells. Such curvature would normally introduce very high radial thrust loads and severly affect print capability. In the present invention the wire bending forces are transmitted to the columnar springs rather than to a bearing (or tab 88 surface), and thus do not introduce wear points in the head for that reason. It should also be noted that the print-cell to nose-bearing distance $S_1$ (FIG. 5) is the same for all print-cells in an array, and has been established at minimum values depending upon OA values selected. In practice, the angle $\theta$ will fall in the range of 10° to 33°.

Therefore, with cells that are capable of being located closer together than in one case demonstrated in FIG. 4, permitting the standard number of print-cells (7) to be located in a 'half-cone', which dimensionally enhances machine aesthetics and cover sizes, more print-cells can be accomodated in a smaller diameter and greater wire-path curvature, to provide a mounting array with shorter wire tracks. Thus, beginning with a cell weighing approximately 8 grams with the print-wire, more cells can be assembled into a print-head of smaller size in width and length than permitted by prior art.

Electromagnet assemblies 10 are therefore mounted in the head casting in the various array patterns as described, with print-wires 68 passing to the nose bearing 86 of suitable pattern and size to accept the planar paths of the several cell assemblies, the print-wire diameter having been suitably selected and matched by the bearing hole diameter, as required. Because of the smaller print-cell size and mass, and their increased numbers in a head array, it is feasible that more wires of a smaller diameter can be made available in some embodiments, to enchance character-dot-development and the appearance of the dot matrix character printed. Guides, or tabs 88 are suitably arrayed in a mounting brace 89 to accomodate the print-wire paths so selected. In some cases of short print-wire path, no brace 88 is required. Although the flat spring of my earlier design prevented any spring flexure at ninety degrees to the plane of motion, which is desireable and particularly adaptable to heavier armatures, a structurally suitable flat spring must be quite thin at the desired spring-rate for higher frequencies, and is therefore structurally unsuitable at high frequencies. In the present invention, the constraint in sidewise movement is no higher than the spring rate of the columnar structure. As a result some slewing or skewing of the print-wire-armature (spring assembly) might be expected, particularly on the return stroke when at least in most matrix impact printers, the moving elements flex on impact with the printing medium and literally bounce irregularly therefrom, also relieving some radial spring tension that has accumulated during the forward (printing) stroke which can not be transmitted into the printed media. In some designs employing free 'ballistic' components this energy resonates an undesireable sound. In the present invention, several factors prevent this from happening. One important factor occurs in the mounting of the print-cell in the head in that the curvature heretofore described in print-wire 68 tensions the moving system (armature, print-wire and spring) away from the core pole faces, and upon energization, resists collapse of the "collapsing trapezoid". This function uses a small portion of the print energy but the effects are more than considerable which favor both the characteristics of noise and high speed function.

The tension is designed to keep the system in alignment. More obviously, slot 82 in preset 30 constrains spring 40 and damps any but nominal motions other than in the desired direction. The basic geometry permits this planar function (placement) of a tension load on the print-wire. Ordinarily, any additional radial load added to the wire path would obviate any attempt to print within reasonable energy levels and power input. As a matter of course, and including the functional parameters of the so-called 'ballistic' wire mechanics, the print-wire is 'bent' as little as possible to reduce radial loads, viz., friction which impedes the wire action. Heretofore, a great many designs were predicated, on reducing the radial loads on the print-wire, some by lengthening the print-wire lengths to reduce the rate of bend.

The present invention is a departure from this requirement of a totally 'relaxed' print-wire, which indeed, adds to the print capability of the wire in a shorter stroke, as virtually none of the normal 'collapse' of the wire (to use up the space afforded in 'free' wire paths), is lost for that effort and a much more direct motion relationship exists between that of the armature and the end of the print-wire.

Further, the effiency of the electromagnet force lines operating along a generally rectangular field co-axial with the direction of required motion, have a stabilizing effect and provide an efficient means of employing the magnetic forces generated by the two core poles.

With the efficiency achieved in damping the armature with the preset and improved mechanical control of the armature, a third and most basic advantage of the invention is being used to its maximum, that of the sine-function (smaller) gap acting on a low mass armature. Calculations show that, according to classic F=MA relations, such a device as here disclosed should not be capable of printing, at least when the total stroke is of the order of 0.005". Yet, the invention has made and does regularly make four copies operating at a frequency of 2,500 Hz permitting only the stroke indicated. It is believed that with this combination of armature-spring control, print-wire geometry and small gap, operating vectors are concentrated solely in the plane of the print-wire axis, and that flexure of the print-wire on impact, is negligible.

Further, on the return stroke, armature surface 48 strikes preset surface 64 initially, compressing it but also 'rocking' preset about the fulcrum 80. This movement also affects slot 82 and, in a few millionths of a second, "nests" spring 40 as it bottoms therein against the back wall of slot 82. It is intended that the spring (which is an integral component of the armature-spring assembly), create a counterforce to the rotational or rocking force created by the initial impact, with the net result that the entire moving system is brought into a total "rest" position in the neighborhood of about 50 μsec. While not wishing to be bound by a particular theory of operation, it is believed that it is these two counteracting forces combine to, at least in part, enable the cell to operate at exceptionally high frequencies, without either undesired resonances or forces that would derogate from the high frequency performance observed.

The adjustment of preset 30 affects the ultimate frequency of the operating unit by virtue of the gap-displacement of the armature-spring assembly. Since the spring rate is relatively unchanged by a slight shortening of the gap by vertical displacement of the armature-spring assembly (as a corollary to advancing the armature-assembly by tilting the preset), the same end condition is achieved. In assembly, slight errors of 'vertical' assembly can therefor be adjusted out by the setting of the preset for a given response time value, the method of establishing the required stroke, printing energy and frequency.

It is fairly straightforward that a low initial tension in the moving system (preload), less power is required to impart motion to it, but, a larger gap has to be traveled which extends the (t) variable of the cyclic function. On the other hand, the gap having been reduced with additional tension applied with the preset, there is much greater magnetic force acting on the armature-spring assembly, and starting from an advanced position the armature-assembly does not have to return as far for each stroke.

However, at the advanced position, the magnet is 'looking' at a greater spring preload which has an affect on the armature motion response time. It can be seen that the spring rate, affecting armature return, is a critical contribution to the frequency operation as the spring must be able to move the armature off of the printed media with the same frequency as the magnet can cause the armature-wire to operate against the media with sufficient print force. It can therefore be seen that there is a practical limit to the 'error' contributed by reducing armature spacing by vertical displacement, as it does so without adding compensatory pre-load to the spring. The CONVERSE is employed by design variations in the placement of armature ramps 58, 60 with respect to the core pole faces 24, 26 in dimensioning the parts, to achieve longer stroke at lower frequency, viz., reducing spring preload.

It should be noted that in my earlier design the print-wire axis corresponded with the center of mass of the armature. In the present invention, while the print-wire is at the center of the armature, this is not the precise center of mass. Because of the greatly reduced mass and higher force ratio acting on the armature with attendant armature alignment control, this change is not deemed alone significant. Also, the mass of the moving system should include a part of the spring components, and this has been a consideration in the present invention.

Why the cell of the invention operates so quietly is difficult to assess, either from an analysis of the integrated functions, or a mechanical measurement of the performance. However, it is known that both the controlled mounting of the armature-spring assembly with its pre-tensioned print-wire, and the action of the preset, described above, are contributing factors. These features describe the possible reason for internal sound performance which is almost 'noiseless' up to approximately 1,200 Hz and does not rise noticeably to the upper print range capability as it is presently known, of 2,550 Hz. Further, there is a noticeable difference in the print sound at the printing surface, which is a reduction of considerable amplitude. It is believed that the smaller air-gap and a very high field strength (magnetic flux density) which is making it possible to print four copies at 2,500 Hz, is by mathematical analysis, doing a certain amount of the work of printing by "squeezing" or "pressing" against the paper, inking role, etc., rather than using solely the forces generated by the velocity of the armature multiplied by its mass.

The normal maintenance of the operating cell should include care to prevent the introduction of debris and foreign materials into the zone of the operating electromagnet assemblies in the head casting. Typically, a perforated sheet metal cover or screen 90 is shaped to assemble conveniently to the head casting for field service, acting as a ventilated dust cover which will permit air to pass over the assemblies 10 during head (casting) movement in operation of the printing machine.

Various changes in the details, steps, materials and arrangements of parts, which have been herein described and illustrated to explain the nature of this invention, may be made by those skilled in the art within the principle and scope of the invention as defined in the appended claims. For example, it is noted that with proper clearance between the armature and print wire (0.0015"), Eastman 910 cement can be used in place of welding or sintering. Also, it will be appreciated that when slower, more powerful printing strokes are desired, no extra holes would be used in the armature. Also, as should be apparent, coils are wired in parallel but with reverse polarity, so that both coils inducing a flux path in the same direction.

What is claimed is:

1. An electromagnet assembly for a dot matrix print head comprising:

a magnetizable armature;

front and rear columnar wire springs secured near the ends of said armature and supporting same for movement from a rest position to a printing position and back without angular change during movement;

a generally W-shaped magnetizable core member having a base;

a pair of legs extending from said base toward said armature, the ends of said legs forming a first pair of pole faces;

a third leg at the rear of said base and forming a tower;

said front spring being secured in said base at the front end thereof, and said rear spring being secured between said tower and the nearest of said pair of legs;

said first pair of pole faces being adjacent said armature and each forming an identical acute angle in the range of 16° to 20° with the axis thereof;

a second pair of pole faces on said armature at the same angle to said axis as said first pair and defining therebetween a pair of air gaps tending to close when said armature moves from a rest position to a printing position;

coil means on said pair of legs;

slightly resilient preset means secured on said tower and including a vertical surface pressing against the rear end of said armature in the rest position;

a vertical slot closely surrounding but not touching said rear spring in the rest position; and a print wire secured in the forward end of said armature.

2. The electromagnet assembly as claimed in claim 1, wherein the forward edges of said first pair of pole faces are flattened.

3. The electromagnet assembly as claimed in claim 1, wherein said springs are secured in said armature and base by welding or sintering.

4. The electromagnet assembly as claimed in claim 1, and additionally comprising means in said base for securing said assembly in a print head.

5. The electromagnet assembly as claimed in claim 1, and additionally comprising set screw means in said tower, whereby said preset may be adjusted with respect to said armature.

6. The electromagnet assembly as claimed in claim 1, wherein said coil means are wound on bobbins having a slight resiliency, said bobbins fitting over said pair of legs with a clearance fit.

7. The electromagnet assembly as claimed in claim 1, wherein said preset means has a vertical cavity fitting loosely over said tower and is secured thereto with a resilient cement.

8. The electromagnet assembly as claimed in claim 1, wherein said coil means are connected in parallel.

9. An electromagnet assembly for a dot matrix print head comprising:

a generally W-shaped, magnetizable core member including a base portion and three upwardly extending legs, the forward pair of legs terminating in a pair of rear-sloping pole faces, and the rear leg forming a tower;

a pair of columnar wire springs secured in said base portion on either side of said pair of legs;

a magnetizable armature secured over said pole faces on said springs and including a pair of forward-sloping pole faces forming an air gap with said rear-sloping pole faces, the slope angle of each pair being identical;

coils on each of said pair of legs;

slightly resilient preset means mounted on said tower and including a surface pressing against the rear end of said armature and a slot surrounding the adjacent spring; and a print wire secured in the front end of said armature.

10. The electromagnet assembly as claimed in claim 9, wherein said slope angle is 16° to 20° to the axis of said armature.

11. The electromagnet assembly as claimed in claim 9, wherein the forward edges of said rear-sloping pole faces are flattened.

12. The electromagnet assembly as claimed in claim 9, wherein said springs are secured in said armature and base portion by welding or sintering.

13. The electromagnet assembly as claimed in claim 9, and additionally comprising means in said base for securing said assembly in a print head.

14. The electromagnet assembly as claimed in claim 9, and additionally comprising set screw means in said tower, whereby said preset means may be adjusted with respect to said armature.

15. The electromagnet assembly as claimed in claim 9, wherein said coils are wound on bobbins having a slight resiliency, said bobbins fitting over said pair of legs with a clearance fit.

16. The electromagnet assembly as claimed in claim 9, wherein said preset means has a vertical cavity fitting loosely over said tower and is secured thereto with a resilient cement.

17. The electromagnet assembly as claimed in claim 9, wherein said coils are connected in parallel.

18. In an electromagnet assembly for driving a print wire in a dot matrix print head, the improvements comprising:

magnetizable armature means secured to said print wire and driving said print wire upon energization of said electromagnet assembly;

two pole faces on said armature means at an angle of 16° to 20° to the axis thereof;

magnetizable core means including a pair of coils and a pair of core pole faces sloped similarly to said armature pole faces and defining therebetween two closeable air gaps;

columnar spring means securing said armature means to said core means near the ends of said armature means; and slightly resilient preset means secured to said core means and adapted to engage the rear end of said armature means in the rest position and including a slot surrounding but not touching the adjacent one of said spring means in all but the operational direction, when in the rest position.

19. The electromagnet assembly as claimed in claim 18, and additionally comprising adjustment means adapted to press said preset means against said armature means and thereby tension said spring means.

20. The electromagnet assembly as claimed in claim 19, and additionally comprising tower means integral with said core means and supporting said preset means, said preset means being secured to said tower means with a resilient cement.

21. The electromagnet assembly as claimed in claim 20, wherein said adjustment means comprises a set screw in said tower means.

22. The electromagnet assembly as claimed in claim 21, wherein said set screw includes a slightly resilient tip.

* * * * *